United States Patent [19]

Axelsson et al.

[11] 4,143,985

[45] Mar. 13, 1979

[54] PILE CONNECTING DEVICE

[75] Inventors: Gunborg H. V. Axelsson, Norrahammar; Kristina E. I. Axgärde, Falkenberg, both of Sweden

[73] Assignee: AB Castings, Malmo, Sweden

[21] Appl. No.: 832,903

[22] Filed: Sep. 13, 1977

[51] Int. Cl.[2] ..... B25G 3/00; F16D 1/00; F16G 11/00

[52] U.S. Cl. ..... 403/287; 403/182; 52/726; 403/231

[58] Field of Search ..... 403/287, 182; 61/53, 61/56; 52/726

[56] References Cited

U.S. PATENT DOCUMENTS

| | | | |
|---|---|---|---|
| 3,356,398 | 12/1967 | Nilsson et al. | 61/56 X |
| 3,884,589 | 5/1975 | Liedholm | 61/56 X |
| 3,953,981 | 5/1976 | Axelsson et al. | 61/53 |

FOREIGN PATENT DOCUMENTS

| | | | |
|---|---|---|---|
| 1178859 | 12/1958 | France | 403/287 |

*Primary Examiner*—Wayne L. Shedd
*Attorney, Agent, or Firm*—Ostrolenk, Faber, Gerb & Soffen

[57] ABSTRACT

A connecting device is described in which two complementary connecting elements comprise several interengaging locking portions with holes for driving pins thereinto to interlock the connecting elements, and spaces inside the locking portions to permit continued driving of the pins thereinto to thereby realize unlocking of the connecting elements.

9 Claims, 15 Drawing Figures

PILE CONNECTING DEVICE

This invention relates to a pile connecting device comprising complementary connecting elements which for interlocking present first and second locking portions with locking holes which in the assembled position of the connecting elements register in pairs or groups to permit driving into said locking portions elongated locking means, preferably in the form of dowel pins.

The invention is specifically useful for connecting devices having such connecting elements in which the first locking portions are in the form of peripherally disposed first locking lugs or the like on the first connecting element, said locking lugs being adapted to cooperate with second locking lugs, countersinks and recesses provided in the second locking portions of the second connecting element. In this type of connecting devices it shall be possible, while retaining the largest possible contact surfaces between the two elements of the connecting device, to drive in the locking means direct from the sides of the connecting elements, but still to release the locking means from their engagement in one or both of the first and second locking portions by exerting continued driving forces on the locking means so that said connecting elements can simply be separated although they were interlocked at an earlier stage.

The instant invention has for its object to provide a connecting device which makes this possible.

To this end there is provided in the connecting device inside each registering pair of holes or each registering group of holes a recess or space formed either between the connecting elements in their said assembled state or in the respective connecting element, and said recess or space is adapted wholly or partly to receive a locking means of relatively restricted longitudinal extension in relation to the horizontal section of the connecting elements when said locking means in its position in said pair of holes or said group of holes is exposed to continued driving forces with a view to permitting release of said locking means by said continued driving forces from at least one portion of said first and second portions and thus cancellation of the locking function of the locking means.

Preferred embodiments disclosing the characteristic features significant to the invention will be described in the following with reference to the accompanying drawings in which FIGS. 1, 2 and 3 show a bottom plan view, side view and top plan view, respectively, of a first embodiment of a connecting element;

Figure 1:
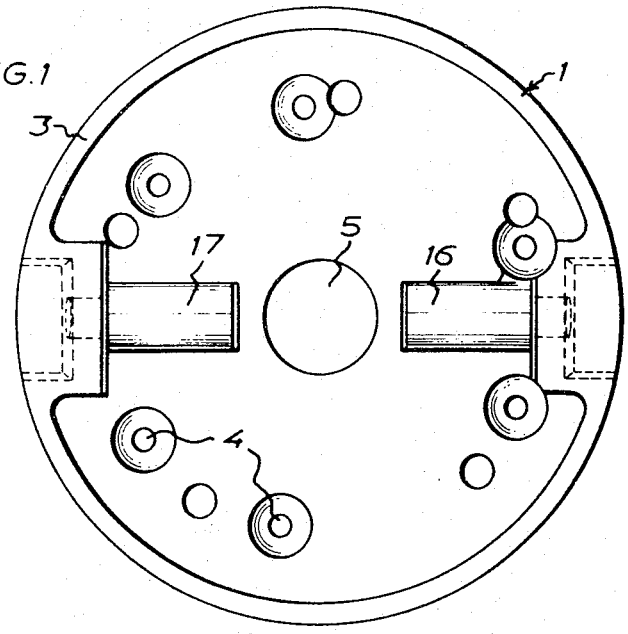
Figure 2:
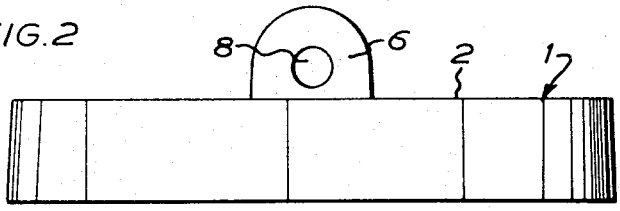
Figure 3:
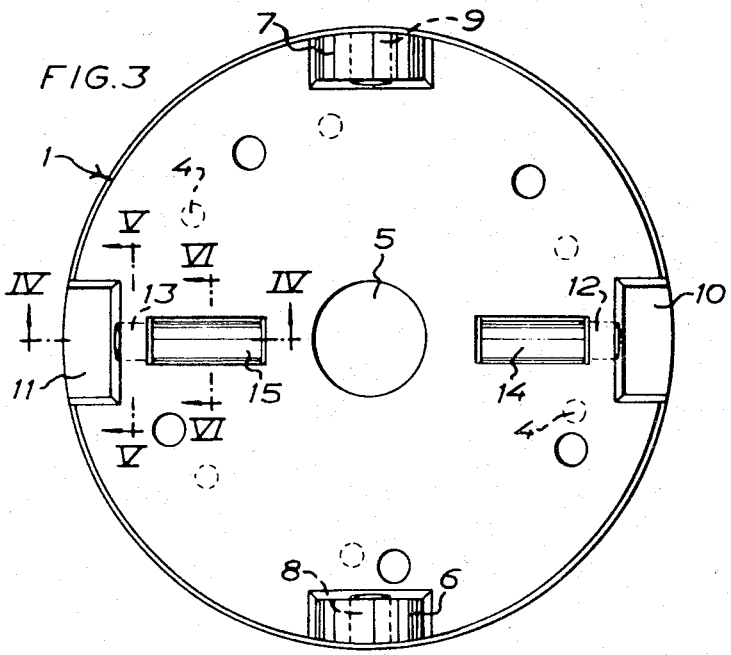

In FIGS. 1–3, 7–9 and 10–12 there is only shown one of the two connecting elements which form a connecting device according to the invention for piles (not shown) since the two connecting elements are of identical design. The pile with which the connecting device is to be used is of the type of concrete piles of the same or different lengths, that are intended to be driven into the ground and to be interconnected at their short ends by means of connecting devices according to the invention. The connecting element in question is fixed to its associated pile int.al. by means of reinforcing rods which are secured in holes, for example screw holes, in said connecting element.

The connecting element illustrated in FIGS. 1–3, 13 has a planar upper surface 2 and an edge 3 projecting downwardly from said upper surface. Holes 4 for the reinforcing rods embedded in the pile are provided in the material beneath the upper surface 2 of the connecting element. A central through inspection hole is designated 5. The connecting element is of substantially circular horizontal section and has at the periphery of its upper surface first locking portions in the form of two locking lugs 6, 7. These are disposed diametrically in relation to each other and are provided each with one first locking hole 8 and 9, respectively. Other locking portions of the connecting element are formed by two countersinks 10, 11 in the upper surface of the connecting element, said countersinks being also disposed diametrically in relation to each other at the periphery. The countersinks are disposed at an angle of 90° relative to the locking lugs and a second locking hole 12 and 13, respectively, is drilled in the inner boundary wall of the locking lugs.

The shape of the locking lugs 6, 7 substantially conforms to the shape of the countersinks 10, 11. The external dimension of the locking lugs is somewhat smaller than the internal dimensions of the countersinks. When the two identical connecting elements are rotated through an angle of 90° in relation to each other and have their upper surfaces with the locking lugs and countersinks arranged therein in facing relationship the connecting elements can be brought together so that the locking lugs in one connecting element engage in and supplement the countersinks in the other connecting element while the locking lugs in the other connecting element engage in and supplement the countersinks in said one connecting element.

The tops of the locking lugs 6, 7 and the bottoms of the countersinks are preferably rounded, and the inner walls of the locking lugs and the countersinks are complementarily inclined, as shown, to facilitate guiding the locking lugs into the countersinks on assembly of the two connecting elements.

Figure 13:
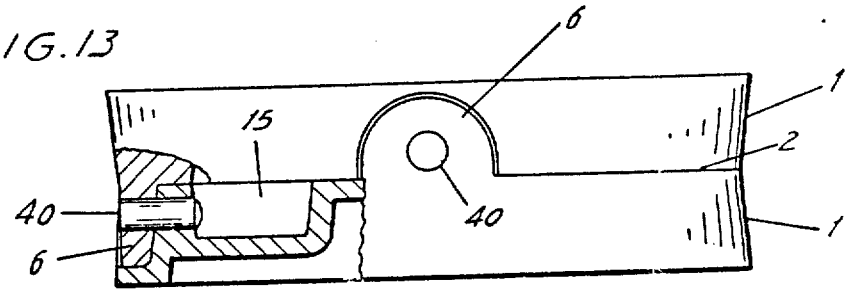
FIG. 13 is a side cross-sectional view showing the connection of two connecting elements of either of the first embodiment.

The position and arrangement of the first and second locking holes 8, 9 and 12, 13, respectively, are such that when the two connecting elements are brought together in the manner described in the foregoing and as shown in FIG. 13, each of the first locking holes 8, 9 in the locking lugs of the two connecting elements register with the second locking hole 12, 13 in the countersink corresponding to the respective locking lugs. There are thus formed four pairs of registering holes in the assembled connecting elements. The dowel 40, of a length sufficient to pass through aligned locking holes, but not much longer, is received in the locking holes, either 8, 12 or 9, 13.

Figure 4:
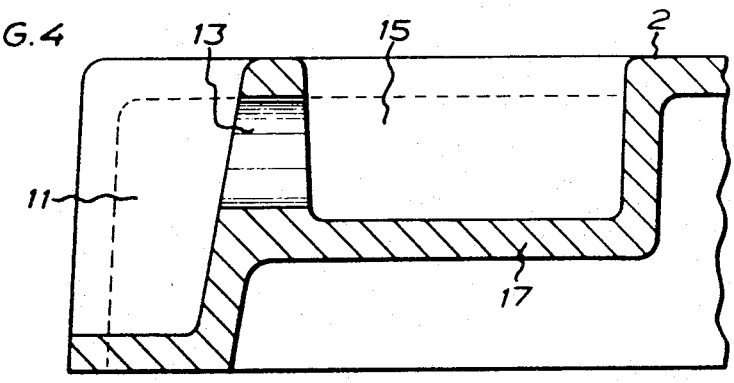
FIGS. 4, 5 and 6 show sections of the connecting element on the lines IV—IV, V—V and VI—VI, respectively, in FIG. 3.
Figure 5:
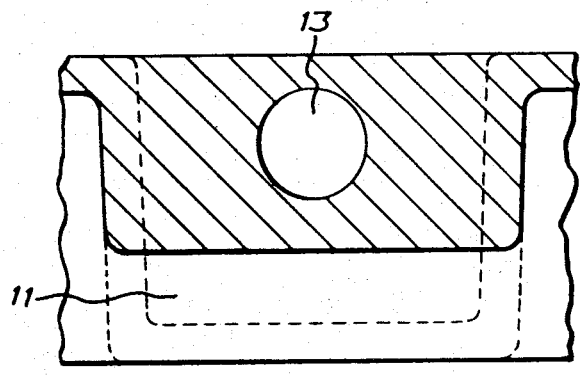
Figure 6:
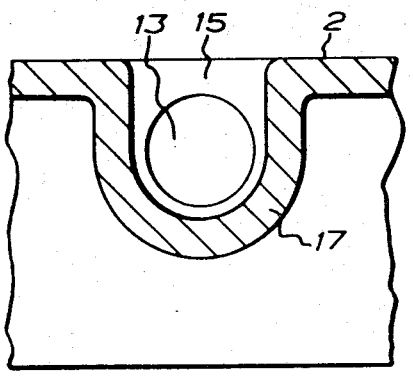
Figure 7:
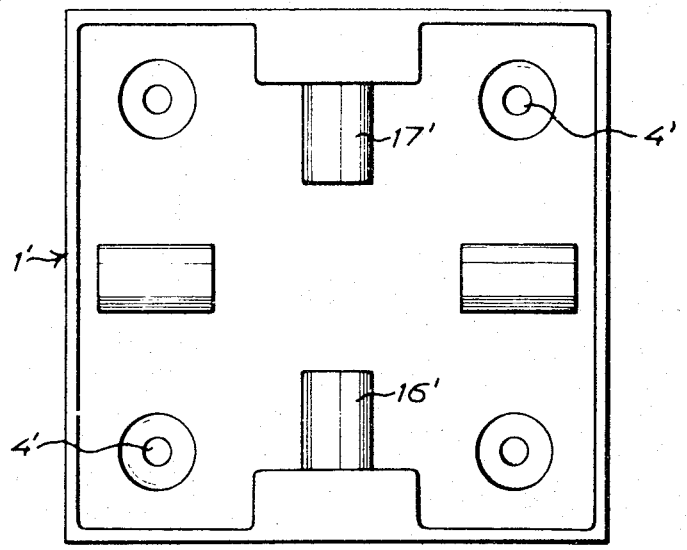
FIGS. 7, 8 and 9 show a bottom plan view, side view and top plan view, respectively, of a second embodiment of a connecting element.
Figure 8:
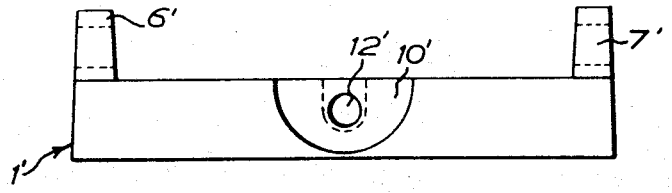
Figure 9:
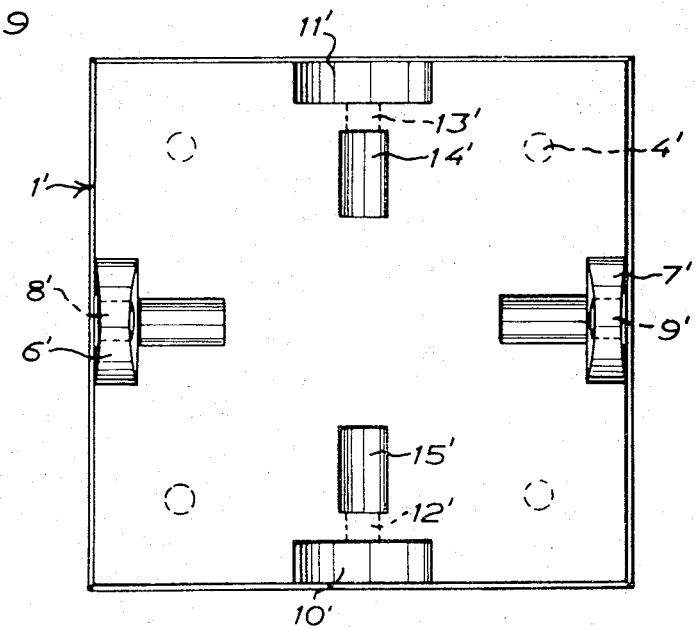
Figure 10:
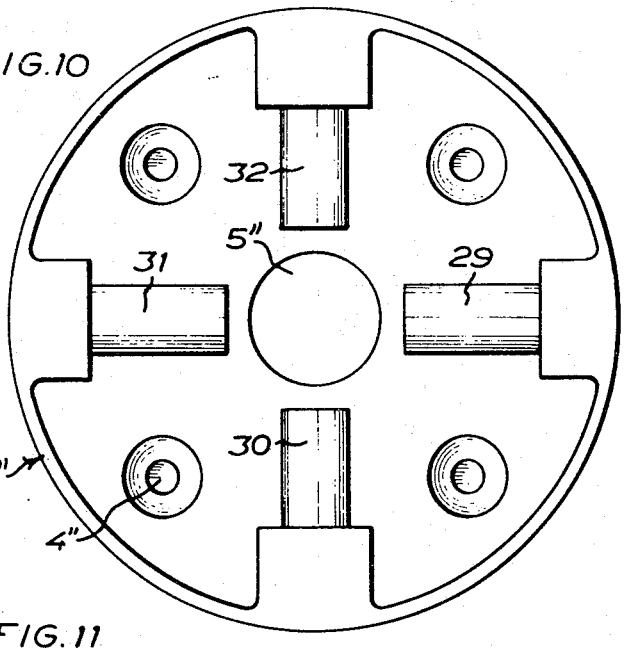
FIGS. 10, 11 and 12 show a bottom plan view, side view and top plan view, respectively, of a third embodiment of a connecting element.
Figure 11:
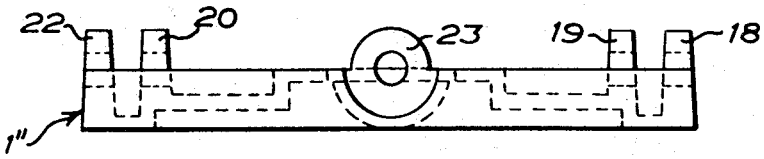
Figure 12:
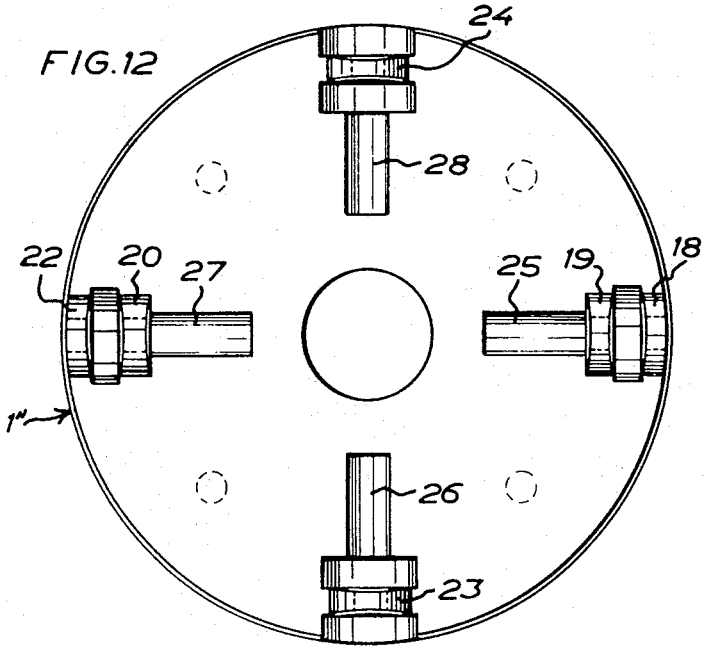

The connecting elements of the connecting device further have a space 14 and 15, respectively, for each hole pair. Each connecting element presents such a space 14 and 15, respectively, inside each countersink 10, 11, said spaces being provided in thickened portions 16, 17 at the underside of the connecting elements according to FIG. 1 and said spaces registering and communicating with the associated second locking hole 12, 13. As will appear from FIGS. 4 and 6 the spaces 14, 15 open into the upper surface 2 so that they can be considered to form two elongated ditches the length of which may be, say $\frac{1}{3}$–$\frac{1}{2}$ of the radius of the circular cross-section.

For interlocking of the connecting elements an elongated locking means, 40, for instance in the form of a dowel pin; is driven into each of four pair of holes which have been formed by assembling the two connecting elements in the above-described manner. Driving of the locking means 40 into the locking device is done from the outer side of the device, i.e. through the holes of the locking lugs and then into the holes associated with the countersinks.

For unlocking the connecting elements further driving forces are exerted on the locking means to force their rear ends entirely out of the first locking holes 8, 9 in the locking lugs 6, 7, which is possible by reason of the spaces 14, 15 communicating with the second locking holes 12, 13. The recesses spaces 14, 15 may advantageously be of a length longer than that necessary to permit such a release of the locking means 40 from the locking lugs 6, 7. Their length can suitably by so large that the locking means 40 can be wholly driven into the space 14, 15, whereupon another locking means 40 can be driven into the hole pair in question, e.g. 8–12. This explains why the lengths of the working means must be limited as described above.

As mentioned in the foregoing the elongated locking means 40 may be a dowel pin of a known type including a cylindrical longitudinally slit sleeve.

FIGS. 7–9, 14 show a second embodiment of the invention which corresponds to the embodiment according to FIGS. 1–6 with the difference, however, that the connecting element in this case is of square instead of circular cross-section. The details of the connecting device according to FIGS. 7–9 bear the same, but primed reference numerals as the corresponding details in FIGS. 1–6. The spaces 14' and 15' are in this case arranged along a line of symmetry between two opposite sides instead of along a diametrical line.

In the third embodiment illustrated in FIGS. 10–12, 15 the connecting element of circular cross-section has a first locking portion in the form of four first locking lugs 18, 19, 20, 22 which are arranged in pairs 18, 19 and 20, 22 diametrically opposite each other, the outer locking lugs 18, 20 lying at the periphery and the inner locking lugs 19, 20 being spaced inwardly from and opposite the outer locking lugs 18, 22. A second locking portion is formed by two diametrically opposite second locking lugs 23, 24 which make an angle of 90° with the first locking lugs and are spaced a short distance inwardly from the periphery of the connecting element. The arrangement is such that two connecting elements of this design can be assembled so that the second locking lugs 23, 24 in one connecting element complementarily engage between the first locking lugs 18, 19 and 20, 22, respectively, which form two pairs on the other connecting element while the second locking lugs in the other connecting element complementarily engage between the first locking lugs forming two pairs on said one connecting element.

Holes are provided in all locking lugs on one and the same level and are so arranged that the three holes formed in each group of first and second locking lugs after the assembly of the connecting elements lie in register and thus permit driving a dowel pin 30 therethrough. Elongated recesses or spaces 25–28 opening into the upper side of the connecting element are provided in thickened portions 29–32 inside and aligned with each pair of first locking lugs and each second locking lug. The recesses or spaces 25–28 communicate with the holes, and the arrangement is such that after assembly of the connecting elements in the manner described above the now superimposed recesses or spaces 25–28 in the two connecting elements permit driving locking means into them through the holes in the first and second locking lugs. The length of the recesses or spaces 25–28 is such that the locking means 40 can be entirely driven into said recesses or spaces through said holes, or at least such that the rear ends of the locking means can leave the holes in the outer ones (18 and 22, respectively) of the pairs of first locking lugs and the holes in the second locking lugs 23 and 24, respectively, for unlocking the connecting elements.

It will have appeared from the foregoing that the connecting elements after their assembly into a connecting device will abut with their upper surfaces.

While preferred embodiments of the invention have been described in the foregoing, those skilled in the art will realize that the invention can be modified within the scope of the appended claims. Thus, for instance the number of locking portions is not restricted to the shown and described number; it may sometimes suffice to have a first and a second locking portion on each connecting element, and sometimes it may be desirable to have more than two first and second locking portions on each connecting element.

What we claim and desire to secure by Letters Patent is:

1. A pile connecting device comprising at least two complementary connecting elements, first and second locking portions on each said connecting element, each said first locking portion on a first said connecting element being received within a said second locking portion on a second said connecting element and each said second locking portion on said first connecting element receiving therewithin a said first locking portion on said second connecting element, locking holes extending through each said first and second locking portion, said locking holes in each of said first and second cooperating locking portions forming a group of holes, each said group extending radially inwardly of the periphery of said device a distance less than one-half the radius of said device, for receiving when said connecting elements are assembled, an elongated locking means extending radially through each said group of holes; a respective elongated locking means for extending radially through each said group of holes; and a recess defined by a connecting element surface extension located radially inwardly of each said group of holes, said recesses each forming a release position for receiving a said locking means whereby when said locking means are all displaced radially inwardly into said recesses, said connecting elements are disengaged.

2. A connecting device as claimed in claim 1, wherein said device comprises two identically alike connecting elements.

3. A connecting device as claimed in claim 2, wherein said first locking portions each are comprised of first locking lugs upstanding at the peripheries of said connecting elements and each having a first through locking hole and said second locking portions each are comprised of countersinks at the peripheries of said connecting elements, said countersinks being complementary in shape in relation to said first locking lugs, and wherein said recesses in said connecting elements are provided radially inward, with respect to said connecting elements, of said countersinks in communication therewith through a second locking hole, said first and second locking holes forming a said group of holes.

4. A connecting device as claimed in claim 2, wherein said first locking portions each are comprised of a first upstanding locking lug at the peripheries of said connecting elements and a second upstanding locking lug spaced inside said first locking lug, said first and second locking lugs having registering locking holes, said second locking portions each are comprised of an upstanding third locking lug having a through locking hole and adapted for engagement between said first and second locking lugs, and wherein said recesses are provided radially inward, with respect to said connecting elements, of said second and third locking lugs in communication with said locking holes of said locking lugs.

5. A connecting device as claimed in claim 3, wherein said connecting elements are circular in plan and each has two said locking lugs which are arranged at the ends of a first diameter of each said connecting element, and two said countersinks which are provided at the ends of a second diameter of each said connecting element, said first and second diameters making right angles with one another.

6. A connecting device as claimed in claim 4, wherein said connecting elements are circular in plan and each has two pairs of said first and second locking lugs, said pairs being arranged at the ends of a first diameter of said connecting element, and each said connecting element having two third said locking lugs which are provided at the ends of a second diameter of the connecting element, said first and second diameters making right angles with one another.

7. A connecting device as claimed in claim 3, wherein said connecting elements are square in plan and each has two said first locking lugs and two said countersinks, said locking lugs and said countersinks being arranged in the middle of a respective side of said square connecting element.

8. A connecting device as claimed in claim 3, wherein said recesses are also countersinks in that surface of each said connecting element from which said locking lugs upstand and in which said countersinks are provided.

9. A connecting device as claimed in claim 4, wherein said recesses are also countersinks in that surface of each said connecting element fromm which the said first, second and third locking lugs upstand.

* * * * *

UNITED STATES PATENT AND TRADEMARK OFFICE

CERTIFICATE OF CORRECTION

PATENT NO. : 4,143,985 Page 1 of 2

DATED : March 13, 1979

INVENTOR(S) : Gunborg H.V. Axelsson et al

Figure 14:
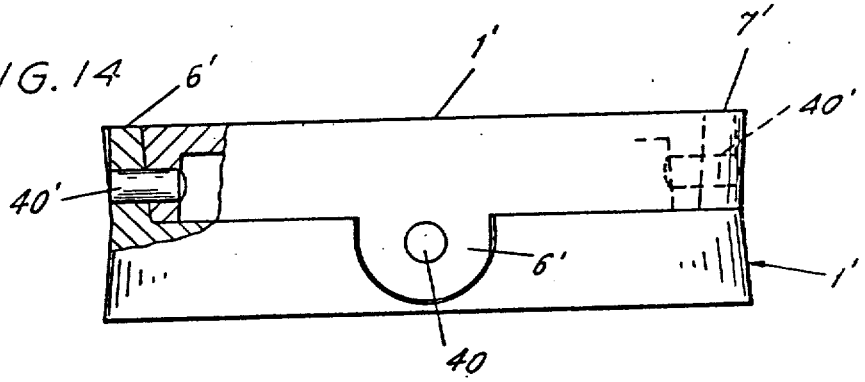
FIG. 14 is a side cross-sectional view showing the connection of two connecting elements of the second embodiment.
Figure 15:
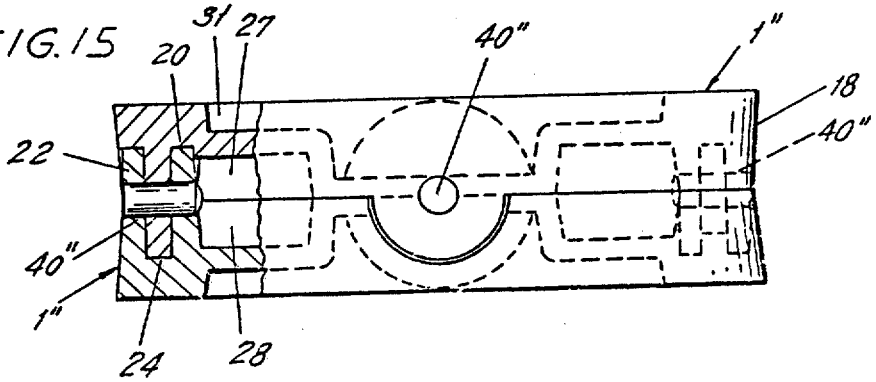
FIG. 15 is a side cross-sectional view showing the connection of two connecting elements of the third embodiment.

It is certified that error appears in the above-identified patent and that said Letters Patent are hereby corrected as shown below:

Please add Drawing Figs. 13, 14 and 15 as shown on the attached sheet.

Signed and Sealed this

*Eleventh* Day of *September 1979*

[SEAL]

*Attest:*

*Attesting Officer*

LUTRELLE F. PARKER

*Acting Commissioner of Patents and Trademarks*